US007205026B2

(12) United States Patent
Groeger et al.

(10) Patent No.: US 7,205,026 B2
(45) Date of Patent: Apr. 17, 2007

(54) METHOD FOR APPLYING A POLYMER COATING TO THE INTERNAL SURFACE OF A CONTAINER

(75) Inventors: Joseph H Groeger, Boston, MA (US); Jeffrey D Nicoll, Boston, MA (US); Joyce M. Wegrzyn, Boston, MA (US)

(73) Assignee: AstraZeneca AB (SE)

( * ) Notice: Subject to any disclaimer, the term of this patent is extended or adjusted under 35 U.S.C. 154(b) by 592 days.

(21) Appl. No.: 10/169,820

(22) PCT Filed: Jan. 8, 2001

(86) PCT No.: PCT/SE01/00027

§ 371 (c)(1),
(2), (4) Date: Nov. 8, 2002

(87) PCT Pub. No.: WO01/51222

PCT Pub. Date: Jul. 19, 2001

(65) Prior Publication Data

US 2003/0121793 A1 Jul. 3, 2003

(30) Foreign Application Priority Data

Jan. 14, 2000 (SE) ..... 0000125

(51) Int. Cl.
*B05D 7/22* (2006.01)
*B05D 3/02* (2006.01)

(52) U.S. Cl. ..... 427/314; 427/236; 427/239; 427/318; 427/388.4; 427/427.4; 427/427.5

(58) Field of Classification Search ..... 427/2.1, 427/2.14, 532, 557, 559, 314, 318, 388.5, 427/388.1, 388.4, 236, 239, 421.1, 427.4, 427/427.5; 118/317, 318
See application file for complete search history.

(56) References Cited

U.S. PATENT DOCUMENTS

| | | | | |
|---|---|---|---|---|
| 2,610,092 A * | 9/1952 | Thompson | ..... | 239/295 |
| 3,274,323 A * | 9/1966 | Petriello | ..... | 264/308 |
| 5,411,771 A | 5/1995 | Tsai | | |
| 5,853,894 A * | 12/1998 | Brown | ..... | 428/422 |

FOREIGN PATENT DOCUMENTS

| | | |
|---|---|---|
| DE | 1546934 | 10/1970 |
| GB | 952573 | 3/1964 |
| GB | 952573 A * | 3/1964 |
| WO | WO 96/32150 | 10/1996 |
| WO | WO 96/32150 A1 * | 10/1996 |
| WO | WO 97/17478 | 5/1997 |

* cited by examiner

*Primary Examiner*—William Phillip Fletcher, III
(74) *Attorney, Agent, or Firm*—Fish & Richardson P.C.

(57) ABSTRACT

Provided is a method for the application of a polymer coating to an internal surface of a container, which method comprises: (a) heating the inside surface of the container to be coated; (b) spraying an aqueous suspension of a fluorine-containing polymer onto the surface to form a coating on the surface; and (c) sintering the coating; wherein the container comprises a base and one or more side walls defining a container opening and is suitable for storing a medicament, and wherein the spraying step is conducted with a first spraying means configured to produce an axial spray pattern that is substantially conical about an axis perpendicular to the container base.

37 Claims, 3 Drawing Sheets

All Canister Diameters Equal

METHOD FOR APPLYING A POLYMER COATING TO THE INTERNAL SURFACE OF A CONTAINER

FIELD OF THE INVENTION

The present invention relates to a process for the application of a polymer coating to an inside surface of a container, and to a container coated with a polymer according to the process of the present invention. In particular, the present invention relates to a process for the application of a polymer coating to an inner surface of a canister used for storing a medicament, to prevent contamination of the medicament and to prevent the medicament from adhering to the container.

BACKGROUND OF THE INVENTION

Fluorine-containing polymers have been known for decades to be useful as protective coatings for various articles. For example, polytetrafluoroethylene (PTFE) has been widely used as a non-stick coating for kitchen utensils, such as frying pans, and tools, such as saws. PTFE and similar fluorine-containing polymers have also found use as hydrophobic protective layers for protecting surfaces against moisture.

More recently, Teflon® (PTFE) and perfluoroethylenepropylene have been used to coat the inner surfaces of aluminium canisters intended for use in the storage and administration of pulmonary medicaments (see EP 0 642 992). Khaladar, Mat Performance 1994, Vol. 33 part 2, 35–9, discloses fluoropolymer coatings for use as linings, whilst International patent application WO 96/32150 discloses fluoropolymer coatings for use as linings in the storage and administration of medicaments. The above coatings are intended to allow alternative propellant systems to be used, whilst preventing the contamination of medicaments with, for example, aluminium.

In the process and products described in EP 0 642 992, there is still a requirement that the process used to apply the coatings is improved, to reduce the roughness of the coatings. The preferred polymer blends of fluoropolymer and adhesive as disclosed in W/O 96/32150 are solvent based systems rather than aqueous systems. Hence, it is also desirable to reduce the quantity of extractable organic compounds used in coating processes (such as solvents) which may contaminate the contents of the container. The use of organic solvents that are flammable has a further drawback in that the equipment used for coating needs to be flame proofed. Also, these coatings require the addition of an adhesive to the polymer, otherwise the coating does not adhere sufficiently to the surface. Such adhesives may be costly and time consuming to apply, and may also be a source of drug contamination.

Accordingly, it is an object of the present invention to solve the problems associated with the prior art. It is also an object of the present invention to provide an improved process for coating an internal surface of a medicine storage container with a fluorine-containing polymer, to provide a finer, more even and unblemished coating with improved protective properties that requires no adhesive or primer, and which contains a minimum of extractable organic compounds. It is also an object of the present invention to provide a process for coating containers using an aqueous polymer suspension and to overcome the difficulties associated with producing good coatings from an aqueous suspension without using organic solvents.

SUMMARY OF THE INVENTION

Accordingly, the present invention provides a method for the application of a polymer coating to an internal surface of a container, which method comprises:

(a) heating the inside surface of the container to be coated;

(b) spraying an aqueous suspension of a fluorine-containing polymer onto the surface to form a coating on the surface; and (c) sintering the coating;

wherein the container comprises a base and one or more side walls defining a container opening and is suitable for storing a medicament, and wherein the spraying step is conducted with a first spraying means configured to produce an axial spray pattern that is substantially conical about an axis perpendicular to the container base.

Thus, in the present invention a polymer material has been selected and processed in a manner that avoids long-term extraction of coating additives into the drug formulation. The lining is optically transparent, colourless, free of microcracks, and chemically stable. The coating can be applied over metallic canisters prepared in a commercial manner. A superior coating can be realised by special surface treatment of the container, by specific application of the polymer coating, including the amount and distribution of the polymer, by specific modification of the polymer, and by specific modification of the application equipment and test protocols; all of which are the subject of this invention.

DETAILED DESCRIPTION OF THE INVENTION

The invention will now be described in further detail by way of example only, with reference to the accompanying drawings, in which.

Figure 1:
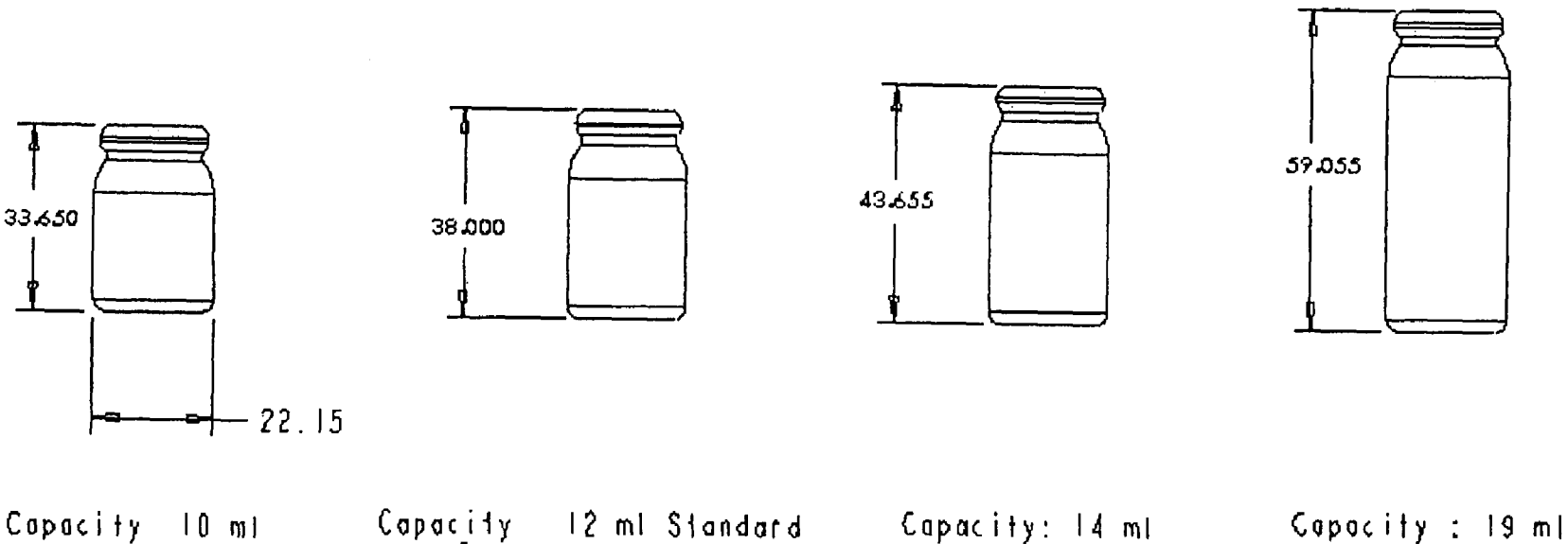
FIG. 1 shows preferred containers used in the present invention, including their preferred form and dimensions.

The process of the present invention will now be described in more detail. The polymer coating is preferably applied by use of adjustable pressure-fed, air-driven spray guns.

Separate air and fluid pressure streams are combined at the delivery end of these guns, with each stream controlled separately, but combined in a synergistic manner to provide a controlled fluid spray pattern, delivery angle, and delivery rate. These guns are fitted with a pneumatically driven piston that allows them to be turned on and off in a controlled manner with respect to spray initiation and duration. Considerable modification of commercially available equipment is required to prevent gelling of the aqueous polymer suspension (such as PFA suspension) within the guns and to allow its application in a highly controlled, stable manner, not otherwise possible. Such modifications include replacement of all non-stainless steel components with stainless steel (preferred type 316). Such modifications further include an internal protective coating to prevent the fluorine-containing polymer from gelling on contacting a reactive internal surface of the spraying means. The protective coating comprises an acrylic-modified epoxy coating, a medical device titanium dioxide-filled epoxy adhesive, paraffin, or beeswax. The angels of the needle and set in the polymer fluid flow control path are preferably highly refined, with controlled heat treatment to prevent wear and provide long-term stable flow control for low viscosity polymers. A segmented, PTFE guide bushing is preferably added to force concentric seating of the needle and/or seat damage due to excess insertion force. The seat is generally removable for ease of inspection and replacement.

The polymer suspension is preferably first introduced into a stainless steel, pressurised reservoir, maintained at a pressure of from $86.2\times10^3$–$89.7\times10^3$ Pa (12.5–13.0 psi) when feeding a single gun and from $86.2\times10^3$–$89.7\times10^3$ Pa (12.5–13.0 psi) when feeding six guns spraying simultaneously. It is preferred that the pressure is controlled to within $\pm0.69\times10^3$–$1.38\times10^3$ Pa (±0.1–0.2 psi) to maintain a more uniform coating. The reservoir should not contain any aluminium components that will have any contact with the suspension. The reservoir is preferably fitted with an electrically driven polymeric paddle that is used to maintain a uniform suspension throughout the process and during times when spraying is not being conducted. The rate of paddle rotation preferably is in the range of 20–50 rpm, with a preferred range of 20–22 rpm. Pressure control in the tank is important to process control and this is preferably accomplished by use of a two-stage, continuous bleed air pressure regulation system with a resolution of $\pm0.69\times10^3$ Pa (±0.1 psi). A digital strain gauge-based pressure gauge system may be interfaced to the process controller to continuously verify pressure stability. The pressure regulator is preferably of a continuous downstream bleed design to allow release of internal pressure due to air expansion during ambient heating.

The polymer suspension is preferably transferred to the spray guns through fluoropolymer tubing, typically consisting of fluorinated ethylene propylene (FEP), with an internal diameter of 3 mm or more. Stainless steel or polymeric fittings are preferably used throughout to prevent gelling of the suspension. In-line shut off valves may be fitted to facilitate purging of air from the polymer feed tubing. Entrapment of air promotes gelling of the polymer suspension, resulting in unstable fluid flow through the guns. Stainless steel filters may be used in line to protect the canisters and spray gun tips against contaminants.

The aqueous polymer coating dries rapidly upon spray application, resulting in an applied film that takes the form of a dry powder. Adhesion to the surface of a non-treated metal canister is very poor if coated without canister preheating. Use of a modified surface, such as anodised aluminium, improves the surface adhesion of the dry film, however it is still very fragile and subject to spalling when impacted during normal handling and transfer on commercial equipment. Further, the coating is very sensitive to application of a second layer since the air pressure tends to spall the previously applied coating. Improved physical stability of the non-sintered polymer can be achieved through formulation addition, as addressed herein.

Thus, an essential component of the process involves pre-heating of the container. Spray application on heated surfaces provides improved film thickness and texture control plus significantly improved adhesion. The preferred temperature range is from 60–95° C., with a more preferred range of 70–85° C.

The coating is preferably applied through two guns, each with a specific configuration. One of these guns is designed and adjusted to produce a conical spray pattern projecting axially from the end of the gun so as to allow coverage of the bottom interior surface of the canister. The axial gun preferably comprises a paint tube diameter of 0.3–1.0 mm, more preferably 0.5–0.7 mm and an air tube with a preferred diameter of 7–10 mm. In a preferred embodiment, the gun is mounted on its bracket such that the end of the tube is preferably around 15 mm above the canister base. The preferred range is from 10–30 mm, with a more preferred range of 10–20 mm and a most preferred range of 12–15 mm (dimension d1 in FIG. 2). The pattern of spray is preferably adjusted such that the conical angle is between 10 and 18°, with a preferred range of 14 to 16° (dimension $\alpha$ in FIG. 2), allowing a pattern to cover just inside the base of the can. The gun may be centred over the open end of the can, with a preferred tolerance of ±0.5 mm. The atomising (dispersing) air pressure is preferably maintained at $0.28\times10^6$–$0.55\times10^6$ Pa (40–80 psi), more preferably $0.41\times10^6$–$1.04\times10^6$ Pa (60–75 psi). The most preferred range is $0.45\times10^6$–$0.48\times10^6$ Pa (65–70 psi). The polymer fluid flow rate is established by adjustment of the gun fluid control needle valve such that the rate is preferably 10–20 ml/min, more preferably 15–20 ml/minute, based on filling of a volumetric measurement vessel with the control valve set to continuous fluid flow, while the atomising air flow is shut off. The preferred range of fluid flow is about 15–18 ml/minute. To obtain a uniform, step-free spray pattern, the gun spray timing is preferably set such that spraying starts as the gun is being retracted from its most proximal stroke position. The end of the spray cycle is preferably set to correspond to a spray that projects approximately 10 mm upward along the interior side wall of the canister.

Figure 3:
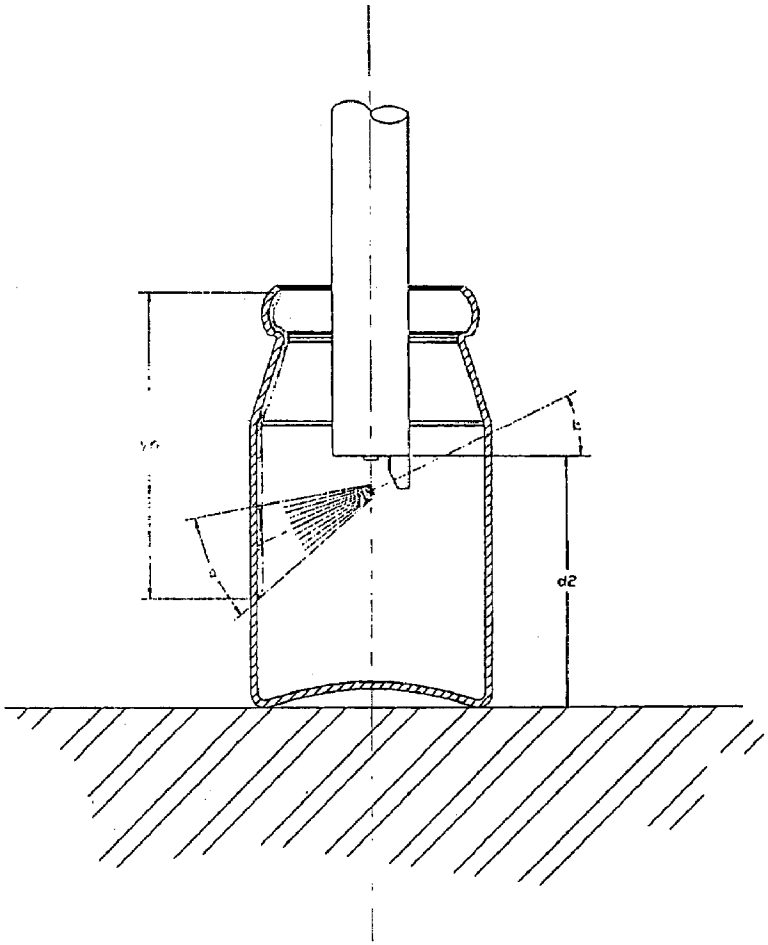
FIG. 3 shows the radial spray pattern used in a method of the present invention—$\alpha$ is the conical angle of the spray pattern, b is the angle of declination of the axis of the radial spray pattern, and d2 is the distance from the end of the spraying means to the base of the container.

A second gun may be employed, designed and adjusted to produce a radial spray pattern that is used to cover the interior side surfaces and neck area of the canister, as shown in FIG. 3. The radial gun preferably comprises a paint tube diameter of 0.3–1.0 mm, more preferably 0.5–0.7 mm and an air tube with a preferred diameter of 7–10 mm. The gun may be centred over the open end of the can with a preferred tolerance of ±0.5 mm. The gun is preferably axially positioned within its mount such that the bottom of the stroke is 10–30 mm from the base of the container, more preferably 12–16 mm from the base of the container (dimension d2 in FIG. 3). The gun may be adjusted to provide a specific spray pattern and angular deflection of this spray pattern with respect to the air tube.

These arrangements are shown in FIG. 3. The atomising air pressure is preferably set to a range of $0.14\times10^6$–$0.41\times10^6$ Pa (20–60 psi), with a more preferred range of $0.14\times10^6$–$0.21\times10^6$ Pa (20–30 psi). The polymer fluid flow rate is set to a preferred range of 4.0–20.0 ml/min., more preferably 5.0–15.0 ml/minute, and most preferably 6.0–14.0 ml/minute. Manual adjustment of the axial position of the air tube relative to the paint tube may be required to obtain a declination angle (b in FIG. 3) with a preferred range of 20–40°, more preferably 25–30°. The spray cone angle (a in FIG. 3) is adjusted by fine changes in the atomising air pressure to a preferred angle of 20–35°, more preferably 25–30°.

Figure 2:
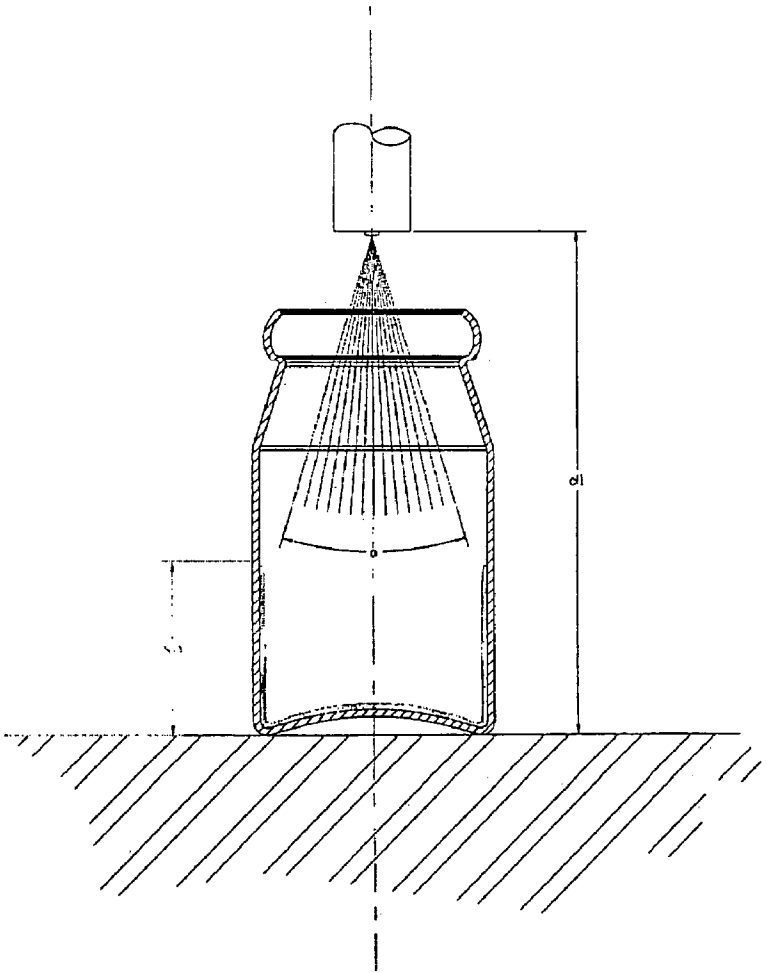
FIG. 2 shows the axial spray pattern used in the method of the present invention—$\alpha$ is the conical angle of the spray pattern and d1 is the distance from the end of the spraying means to the base of the container.
Figure 4:
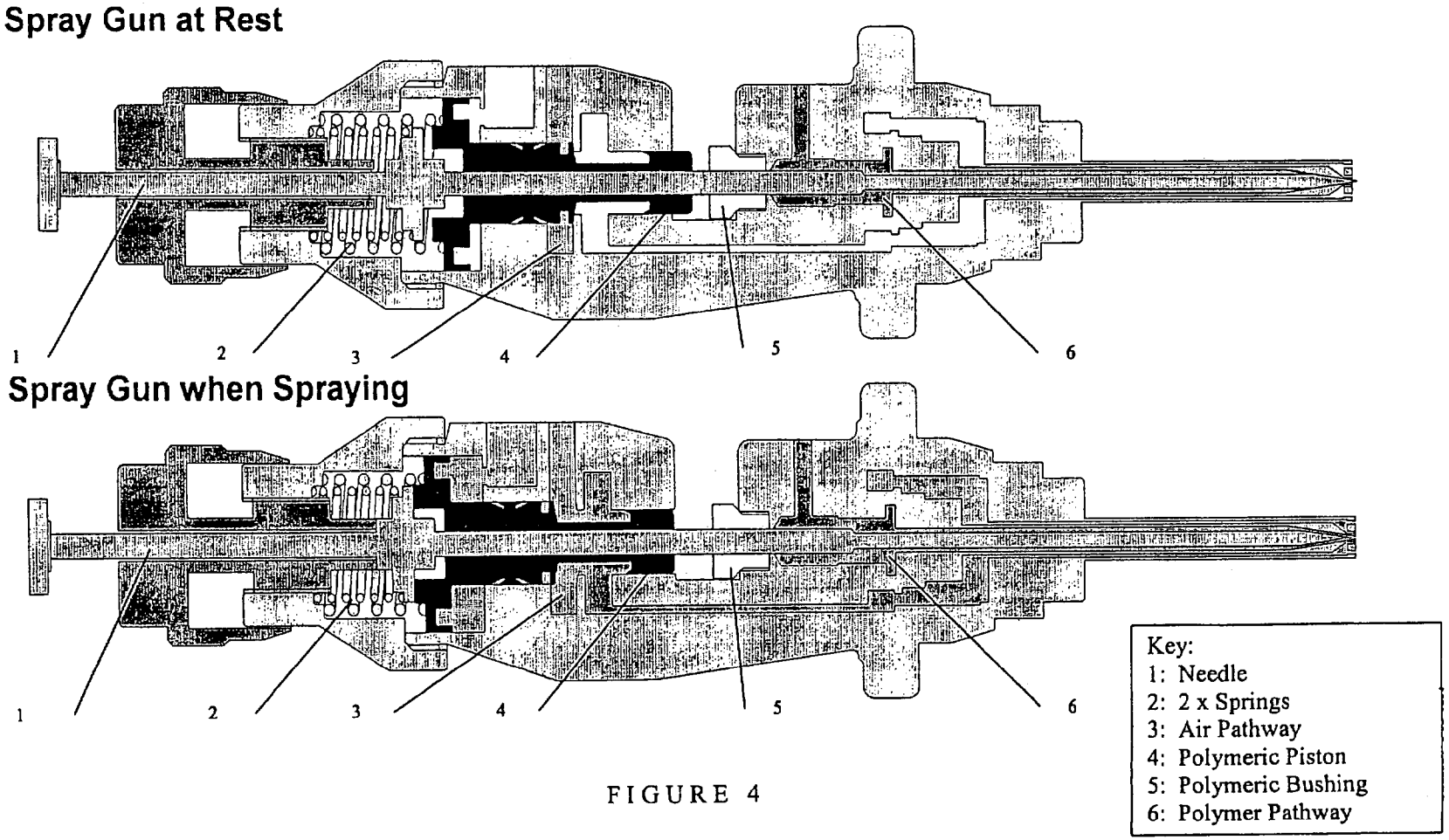
FIG. 4 shows a spray gun which can be used in the present invention.

A variation of the coating process makes use of a single coating application, using a gun configured for axial spray delivery. The configuration shown in FIG. 2 is preferred and the angular conditions, atomising air pressure, and polymer fluid flow rate conditions are as described above. The stroke timing is extended to provide full coverage of the interior surface, up to and across the upper surface of the cut edge on the canister neck, without over-spray reaching the exterior surface of the neck.

The guns are preferably mounted on an articulated carriage, allowing them to stroke in and out with respect to the container, the latter of which faces the guns with its open end. The guns may have a fixed angular relationship relative to the equipment or they may be articulated through a limited angular displacement such that their dynamic stroke keeps pace with the containers as they move continuously in a carousel. Each container may be supported on its exterior surface through use of a collet. The containers are preferably made to continuously spin on their major axis at from 600–900 rpm during spray application.

Spray application of the polymer coating may be accomplished by combined articulation of the guns into and out of the spinning canisters and carefully controlled timing of the spray action and coordination between the polymer flow rate and duration of spray delivery. Coating may be initiated with the axial gun. The bottom interior surface is sprayed and coating with this gun projects upward from the base, extending upward along the interior side wall. This gun is then shut off and withdrawn, allowing the canister to be conveyed to a radial gun. This is introduced and lowered into the canister as described above and coating begins over the partially dried previous layer. There may be a degree of intentional overlap between the coatings applied with each gun. Radial spray action is initiated as the gun is withdrawn, and continues until the gun just exits the canister.

The applied coating is very fragile prior to sintering. Special precautions are preferably taken to avoid impact damage to the containers that might lead to coating loss from any surface. Low resiliency, thermally stable impact absorbing cushions may be fitted to each point in the line where any impact occurs between the coated containers and metal surfaces. Viton®, a fluoropolymer elastomer, is used as a preferred option, with other elastomers, such as polyurethane, ethylene-propylene and others being available.

The coating is made permanent through a thermal sintering treatment. The containers are preferably supported on their exterior surface in a convection oven at 320–400° C., preferably 350–390° C. and most preferably at 370–380° C., for approximately 10.0±0.5 minutes. This heat exposure causes the polymer particles to melt and fuse to form a continuous surface coating of very high quality and smoothness.

Inspection of the coating integrity may be determined through an immersion test method on a statistical basis. For this procedure, a solution of acidified copper sulphate is used. This is prepared by dissolving copper sulphate in distilled water to a concentration of 15 wt. %, followed by acidification with hydrochloric acid (38 wt. %) to a concentration of 2 wt. %. The interior of the canister being inspected is filled with this solution at room temperature. This is allowed to sit for 60±5 seconds, then the solution is removed. Visual inspection of the interior surface is conducted and areas where the coating integrity is violated will appear to be red-black due to chemical reaction between the aluminium and copper sulphate.

For inspection of anodised aluminium canister surfaces, a special modification of this process may be employed. A solution of 2 wt. % sodium hydroxide in distilled water is prepared. The interior of the canister is first filled with this solution up to the level of just below the neck. This solution is left in place for 60±5 seconds, followed by removal and rinsing with distilled water. This treatment breaks down exposed areas of aluminium oxide that would otherwise not be attacked by the standard acidified copper sulphate solution. Following the rinse, acidified copper sulphate solution, as described above, is introduced into the canister for 60±5 seconds, followed by visual examination of the interior for evidence of chemical attack (presence of red-black reaction product).

Using the processes described herein, it is possible to obtain coatings that exhibit zero attack by either of the foregoing chemical test methods.

Coating integrity and quality can be further assessed by use of the Wilkens Anderson Company (WACO) Enamel Rater II electrolytic test method. This system applies 6.3 V DC to the canister, filled with an electrolyte (1.0 wt. % sodium chloride in distilled water), through a stainless steel electrode. The outer surface of the canister is connected in series with the electrode and test sample to a measuring bridge. With an applied potential of 6.3 V and 4 seconds of stabilisation time, the current flow through non-surface treated, polymer coated canisters may range from 5–100 mA, preferably from 10–80 mA, when coated with the foregoing material and process. When applied over anodised canister surfaces, the WACO test current may range from less than 5.0 mA (0–5.0 mA), preferably from less than 1.0 mA (0–1.0 mA).

The containers may be metal canisters produced using a deep drawing operation. Aluminium alloy 5052 is preferably used to facilitate subsequent anodising. Stainless steel canisters are also available and may be coated with the polymer addressed herein. Following deep drawing, canisters are cleaned with an aliphatic hydrocarbon degreaser and surfactant, followed with a series of rinses with deionised water. In a preferred process, the canisters are then lightly anodised to produce a specific surface condition and high degree of cleanliness, without a trace of extractable organic compounds.

Anodising is preferably conducted using an electrochemical sulphuric acid Forest Products Laboratory (FPL) process with a carbon electrode. Generally, the containers are first exposed to a mixed acid bath (sulphuric, nitric, and chromic acids, for example) for surface cleaning. The canisters are then connected to an alternating current source through a titanium spring clamp secured to the exterior surface of the neck. Anodising may take place with an applied current of 10 V AC, for a period of 5 minutes following immersion in sulphuric acid to produce an oxide layer with a specific microstructure approximately 0.8 μm in thickness. The preferred range is 0.6–0.9 μm. The canisters are next heat-sealed through immersion into a water bath at 90° C., then rinsed through several stages in controlled purity water, followed by a pure water final spray rinse, then dried with forced heated air convection. Dryness may be assured and controlled through differential temperature probes and associated software that determines the dew point of the oven exhaust air stream. The thickness of the anodised layer may be measured by ultraviolet/visible light spectroscopic absorbance, calibrated against metallographic examination of representative anodised canister cross-sections.

If the anodised layer is too thick, subsequent cracking may take place during the polymer sintering process. If too thin, the process may not be controlled as well as desired and the adhesion and surface cleanliness benefits may be sacrificed.

Since the sintering process for the polymer coating requires a temperature in the annealing range of the 5052 aluminium alloy, the canister design has been modified over standard conditions to include a thicker wall.

The lining may comprise a proprietary perfluoroalkoxy (PFA) polymer, prepared as an aqueous suspension of finely divided PFA polymer. The PFA polymer may be prepared in an aqueous polymerisation process. PFA particle size in this suspension preferably ranges from 0.1–100 μm. The aqueous phase may include a non-ionic surfactant, such as octylphenoxy polyethoxy ethanol. The suspension preferably has a pH range from 2–10, preferably from 2–5 (non-buffered), resulting from residual acidic compounds present from the polymerisation process. The polymer may be modified through addition of polyethylene glycol, (PEG) as an application synergist The polymer may be sprayed onto the interior surface of the canister using single or dual pass spray-cure cycle, followed with drying and sintering processes, as addressed herein. Prior to sintering, the surface coating has the form of a dry powder, tenuously adhered to the canister surface. The finished product features a uniformly smooth, colourless, transparent PFA film with a thickness of 1–10 μm, preferably covering the entire interior surface area and interior profile and upper edge of the canister neck.

The polymer may require certain precautions in handling since it has a tendency to settle and to form a gelatinous state when the net concentration of solid material increases above approximately 65 wt. %. The polymer reacts very adversely with aluminium and aluminium alloys and, to a lesser degree, with metal alloys containing zinc. This includes brass and galvanised steels. In such a case, the reaction product is an intractable solid that cannot be re-suspended. As a result of this reaction, all storage and conveyance equipment, including the spraying equipment, should be manufactured with non-reactive metals, such as stainless steel, and polymers that are free of leachable additives. Acceptable polymeric materials include fluorinated ethylene propylene (FEP) and polytetrafluoroethylene (PTFE).

Stabilisation of the PFA suspension can be achieved by increasing the pH to neutral condition. This can be accomplished by addition of a number of buffers, including, but not limited to ammonium hydroxide.

Further stabilisation and improved adhesion of the pre-sintered PFA suspension can be achieved by addition of polyethylene glycol (PEG). Such addition is through use of USP grade material, added first to distilled water, then to the PFA suspension. The PEG molecular weight range is from 400 to 20,000, with a preferred range from 5,000 to 7,000. The concentration of PEG has a range from 0.2–1.5 wt. %, with a preferred range of 0.5–1.0 wt. %. PEG is evaporated from the final coating during the sintering operation.

A special metered dose inhaler (MDI) has been developed in the present invention for controlled delivery of an active pulmonary or nasal medication. The container comprises a lined container obtainable using the process of the present invention described above. The inhaler is thus preferably comprised of a deep drawn aluminium alloy cylinder, lined with a specially processed perfluoroalkoxy (PFA) polymer added to limit drug adhesion, agglomeration, potentially adverse interaction with the aluminium canister and residual materials used for its production.

The present invention also provides a container for storing a medicament, which can be produced by the process of the present invention. The container comprises a lining formed from the fluorine-containing polymer on the surface of at least an internal side wall or base. It is preferred that the lining has a roughness value, Ra, on a side wall of 0.75 or less. When the container is an aluminium container having an internal surface that has been anodised, it is preferred that the fluorine-containing polymer lining has a roughness value, Ra, on a side wall of 0.75 or less. The roughness value of the lining on a base is preferably 1.40 in the case of a standard canister and also 1.40 in the case of an anodised canister.

The roughness value Ra can be measured using a Microfocus Compact® measurement system. This is an opto-electronic three dimensional (3D) measurement system for non-contact measurement and surface analysis. A low intensity laser beam scans the surface quantifying the peaks and troughs (e.g. in μm) and averaging the figures to give an Ra value.

The invention will now be described in further detail by way of example only, with reference to the following specific embodiments.

EXAMPLES

Eight standard non-anodised aluminium canisters and ten anodised aluminium canisters were taken, and substantially the entire internal surface of the canisters was coated. The standard canisters were given two coats of polymer, each time using an axial gun spraying pattern. The anodised cans were given a single coat of polymer using an axial gun spraying pattern.

The surface topography was measured using a Microfocus Compact® measurement system. Measurements were taken on a side wall of the canisters. The coating was sputtered coated with gold prior to carrying out the measurements (VG Microtech Model SC7640 sputter coater) to improve surface reflectance. The area measured was 0.5 millimeters by 0.5 millimeters, with a point density of 100 points per millimeter. The roughness values for the individual canisters, as well as the mean, maximum and minimum roughness values for anodised and standard canisters, are shown below in Table 1.

TABLE 1

| Anodised Can Number | Roughness (Ra) | Standard Can Number | Roughness (Ra) |
|---|---|---|---|
| 1 | 0.48 | 1 | 0.58 |
| 2 | 0.53 | 2 | 0.58 |
| 3 | 0.53 | 3 | 0.57 |
| 4 | 0.47 | 4 | 0.71 |
| 5 | 0.61 | 5 | 0.40 |
| 6 | 0.59 | 6 | 0.32 |
| 7 | 0.60 | 7 | 0.46 |
| 8 | 0.58 | 8 | 0.53 |
| | | 9 | 0.61 |
| | | 10 | 0.39 |
| | Mean 0.55 | | Mean 0.52 |
| | Min 0.47 | | Min 0.39 |
| | Max 0.61 | | Max 0.71 |

Selected cans formed in the above procedure were tested (using the Microfocus Compact® system mentioned above) to determine the roughness values of the polymer lining at their base. The values obtained are shown below in Table 2.

TABLE 2

| Anodised Can number | Roughness (Ra) | Standard Can number | Roughness (Ra) |
|---|---|---|---|
| 1 | 0.56 | 3 | 0.64 |
| 3 | 1.16 | 4 | 0.79 |
| 5 | 0.74 | 7 | 0.68 |
| 6 | 0.72 | 8 | 1.38 |
| 7 | 1.13 | 10 | 0.67 |
| | Mean 0.86 | | Mean 0.83 |
| | Min 0.56 | | Min 0.64 |
| | Max 1.16 | | Max 1.38 |

To investigate the thickness of the coatings applied by the present methods, the thickness of the coatings was measured on the base area and the wall area of two batches of standard cans and one batch of anodised cans, coated as described above. For each area, the mean, minimum and maximum values are given in Table 3 below.

TABLE 3

| Standard Can Batch 1 thickness/μm | Standard Can Batch 2 thickness/μm | Anodised thickness/μm |
|---|---|---|
| Base area | Base area | Base area |
| Mean 8.32 | Mean 7.81 | Mean 4.98 |
| SD (on means) 0.63 | SD (on means) 0.56 | SD (on means) 0.56 |
| Min. 7.02 | Min. 6.33 | Min. 4.98 |
| Max. 9.86 | Max. 8.91 | Max. 7.28 |
| Wall area | Wall area | Wall area |
| Mean 5.53 | Mean 4.95 | Mean 3.14 |
| SD (on means) 0.55 | SD (on means) 0.41 | SD (on means) 0.47 |
| Min. 3.43 | Min. 2.14 | Min. 1.38 |
| Max. 7.64 | Max. 8.50 | Max. 5.58 |

The above results demonstrate that the processes of the present invention produce containers having a superior (less rough) lining. This leads to the advantage that container contents, such as medicaments, do not adhere to the present linings. The tests also show that a relatively thin polymer coating can be applied to achieve this effect.

In addition to the above tests, the coating integrity was tested according to the immersion test method described above. Visual examination of the interior of the cans revealed that none of the cans displayed any sign of chemical attack. This demonstrates the suitability of the cans for storing medicaments.

The invention claimed is:

1. A method for the application of a polymer coating to an internal surface of a container, which method comprises:

(a) heating the inside surface of the container to be coated;

(b) after heating the inside surface, and while the inside surface is heated, spraying an aqueous suspension of a florine-containing polymer onto the surface to form a coating on the surface; and (c) sintering the coating;

wherein the container comprises a base and one or more side walls defining a container opening and is suitable for storing a medicament, and wherein the spraying step is conducted with a first spraying means configured to produce an axial spray pattern that is substantially conical about an axis perpendicular to the container base.

2. A method according to claim 1, wherein the spraying step is conducted with an additional second spraying means configured to produce a radial spray pattern that is substantially conical about an axis which comprises a component that is perpendicular to the axis of the spray pattern of the first spraying means.

3. A method according to claim 1, wherein step (b) and optionally step (c) are repeated to ensure that two or more coatings are formed on the surface.

4. A method according to claim 1, wherein in step (a) the surface is heated at from 60–95° C.

5. A method according to claim 1, wherein in step (c) the coating is sintered at from 320–400° C.

6. A method according to claim 1, wherein the container comprises a metal canister.

7. A method according to claim 6, wherein the metal comprises aluminium or stainless steel.

8. A method according to claim 7, wherein the metal comprises aluminium and the surface to be coated is first anodised such that an oxide coating is formed on the surface having a thickness of from 0.6–0.9 μm.

9. A method according to claim 8, wherein a single fluorine-containing polymer coating is applied to the surface.

10. A method according to claim 1, wherein the volume of the container is 100 ml or less.

11. A method according to claim 10, wherein the volume of the container is from 5–25 ml.

12. A method according to claim 1, wherein the base portion of the container is situated opposite the container opening.

13. A method according to claim 12, wherein the container further comprises a neck portion below the container opening.

14. A method according to claim 12, wherein the cross-section of the container, taken radially, is substantially circular and the base portion has a diameter of from 1.0–3.0 cm.

15. A method according, to claim 12, wherein the length of the container from the base to the opening is from 2.0–70.0 cm.

16. A method according to claim 12, wherein, when in operation, an exit of the first spraying means from which the fluorine-containing polymer spray emerges is situated from 6.0–9.0 cm from the base of the container.

17. A method according to claim 12, wherein the axial spray pattern has a conical angle of from 10–18°.

18. A method according to claim 12, further comprising a second spraying means, wherein, when in operation, an exit of the second spraying means from which the fluorine-containing polymer spray emerges is situated at 1.0 cm or more from the base of the container.

19. A method according to claim 12, further comprising a second spraying means, wherein, when in operation, an exit of the second spraying means from which the fluorine-containing polymer spray emerges is situated at a minimum distance of not more than 1.0 cm from the axis perpendicular to the container base.

20. A method according to claim 12, wherein the angle of declination of the axis of the radial spray pattern is from 20–40%.

21. A method according to claim 12, wherein the radial spray pattern has a conical angle of from 20–35°.

22. A method according to claim 2, wherein the first spraying means is employed to form a coating on at least a portion of the base of the container and the second spraying means is employed to form a coating on at least a portion of the side walls of the container.

23. A method according to claim 1, wherein the coating is formed on substantially the entire internal surface of the container.

24. A method according to claim 1, wherein the thickness of the polymer coating on the surface is from 1–10 μm.

25. A method according to claim 1, wherein the fluorine-containing polymer comprises a perfluoroalkoxy (PFA) polymer; a copolymer of tetrafluoroethylene (TFE) and perfluoropropyl vinyl ether (PPVE); or a copolymer of TFE and perfluoromethyl vinyl ether (PMVE).

26. A method according to claim 1, wherein the fluorine-containing polymer is provided in the form of an aqueous suspension comprising from 30–70 wt. % based on solid material of the fluorine-containing polymer.

27. A method according to claim 26, wherein the average particle size of the fluorine-containing polymer in the suspension is from 0.1 μm–100 μm.

28. A method according to claim 26, wherein the suspension further comprises a non-ionic surfactant.

29. A method according to claim 26, wherein the pH of the suspension is from 2–10.

30. A method according to claim 1, wherein the fluorine-containing polymer is optionally modified by addition of polyethylene glycol (PEG) to the suspension.

31. A method according to claim 1, wherein the first spraying means comprises a gun configured to produce a conical spray pattern projecting from a nozzle at an end of the gun.

32. A method according to claim 1, wherein the first spraying means comprises an internal protective coating to prevent the fluorine-containing polymer from gelling on contacting a reactive internal surface of the spraying means.

33. A method according to claim 32, wherein the protective coating comprises an acrylic modified epoxy coating, a medical device titanium dioxide-filled epoxy adhesive, paraffin, or beeswax.

34. A method according to claim 1, further comprising a second spraying means, wherein the second spraying means comprises a gun configured to produce a conical spray pattern projecting from a nozzle at an end of the gun.

35. A method according to claim 1, further comprising a second spraying means, wherein the second spraying means comprises an internal protective coating to prevent the fluorine-containing polymer from gelling on contacting a reactive internal surface of the spraying means.

36. A method according to claim 35, wherein the protective coating comprises an acrylic modified epoxy coating, a medical device titanium dioxide-filled epoxy adhesive, paraffin, or beeswax.

37. A method according to claim 1, wherein the spraying step is conducted with an additional second spray means configured to produce a radial spray pattern that is substantially conical about an axis that has an angle 50–70° to the axis of the spray pattern of the first spraying means.

* * * * *